US005100250A

United States Patent [19]

Suzuki et al.

[11] Patent Number: 5,100,250

[45] Date of Patent: Mar. 31, 1992

[54] CASSETTE FOR THERMAL TRANSCRIPTION FILM

[75] Inventors: Tsugio Suzuki; Akira Shimizu, both of Katsuta, Japan

[73] Assignee: Hitachi, Ltd., Tokyo, Japan

[21] Appl. No.: 626,006

[22] Filed: Dec. 12, 1990

[30] Foreign Application Priority Data

Dec. 25, 1989 [JP] Japan ..... 1-332702

[51] Int. Cl.[5] ..... B41J 35/28

[52] U.S. Cl. ..... 400/208

[58] Field of Search ..... 400/208, 208.1, 207, 400/223, 236, 236.1, 236.2, 194, 196; 242/68.1, 68.2, 68.4, 68.5, 73, 197, 198, 196, 200, 201, 202

[56] References Cited

U.S. PATENT DOCUMENTS

| | | | |
|---|---|---|---|
| 4,160,603 | 7/1979 | Neubaum | 400/208 |
| 4,702,631 | 10/1987 | Watanabe | 400/208 |
| 4,768,039 | 8/1988 | Akutagawa et al. | 400/208 |
| 4,915,516 | 4/1990 | Shimizu et al. | 400/208 |
| 4,924,242 | 8/1990 | Fukawa | 400/236.2 |

FOREIGN PATENT DOCUMENTS

| | | | |
|---|---|---|---|
| 2505739 | 11/1982 | France | 400/236 |
| 0120078 | 6/1985 | Japan | 400/236 |
| 0187060 | 8/1987 | Japan | 400/236 |
| 2162794 | 2/1986 | United Kingdom . | |
| 2169875 | 7/1986 | United Kingdom | 400/236.2 |

OTHER PUBLICATIONS

Patent Abstracts of Japan-May 15, 1989, vol. 12, No. 204.

European Search Report EP 90 12 4230.

*Primary Examiner*—Eugene H. Eickholt

*Attorney, Agent, or Firm*—Antonelli, Terry, Stout & Kraus

[57] ABSTRACT

A thermal transcription film cassette for use in a thermal transcription recording device. Engagement portions on three of four ends of a pair of spools are formed into the same shapes, with an ink film being wound around the pair of spools. Engagement portions on one of the four ends of the pair of spools are formed into shapes which are different from the shapes of the engagement portions on the remaining three ends of the spools. When the pair of spools are mounted in the cassette, they are prevented from being erroneously mounted.

1 Claim, 4 Drawing Sheets

CASSETTE FOR THERMAL TRANSCRIPTION FILM

BACKGROUND OF THE INVENTION

The present invention relates to a thermal transcription film cassette for use in a thermal transcription recording device.

Ink film housing cassettes for thermosensitive transcription recording devices, in which A6-sized recording paper is used, are manufactured at low cost and are disposable.

Large, non-disposable ink film housing cassettes are utilized in thermosensitive transcription recording devices, in which recording paper of A4 size or more is used. Ink films which are would around are directly mounted in the devices, or ink films are so shaped as to be capable of being replaced, as disclosed in Japanese Utility Model Laid-Open No. 63-163953.

The above conventional art permits easy replacement of an ink film. However, a problem resides in the fact that consideration has not given with respect to the mounting directions and maintenance of the ink film when the ink film is being mounted in the cassette. In other words, the winding side of the ink film is erroneously mounted to the feeding side of the ink film or vice versa while the ink film is being mounted.

An object of the present invention is therefore to provide a cassette for thermal transcription ink films in which it is easy to maintain and replace the ink films, and in which the films can be mounted without fail.

SUMMARY OF THE INVENTION

To achieve the above object, engagement portions on three ends of a pair of spools are formed into the same shapes, the spools being on the sides of winding and feeding an ink film. Members are provided which are capable of being engaged with and fitted to the engagement portions on the three ends. Members are also provided which are capable of being engaged with and fitted to the other one end of the pair of spools. A mechanism is provided in a cassette, this mechanism restricting, in the axial directions, the positions of the pair of spools.

Three of the four ends of a pair of spools are formed into the same shapes, with the spools being on the sides of winding and feeding the ink film. One of the four ends of the pair of spools is formed into a shape which is different from the shapes of the remaining three ends of the spools. Members, capable of being engaged with the engagement portions on the three ends of the pair of spools, are provided in the cassette. Members, capable of being engaged only with one end of the pair of spools, are also provided in the cassette. For the above reasons, when the ink film spools in which the winding side and the feeding side are arranged in pairs are mounted in the cassette, they are prevented from being erroneously mounted. Furthermore, since the mechanism for restricting, in the axial directions, the positions of the pair of spools is provided in the cassette, it is easy to maintain the ink film after it has been mounted.

The present invention having the above components brings about the following advantages.

It is possible to easily mount an ink film. This is because engagement portions are formed on both sides of the ink film spools around which an ink film is wound, these ink film spools having the winding side and the feeding side in pairs. Spool drive members are provided on one side of the cassette, which spool drive members are capable not only of being engaged with the engagement portions on one end of the pair of spools, but also of transmitting turning force to the pair of spools. Members having the mechanism are provided on the other side of the cassette, with this mechanism being engaged with the engagement portions on the other end of the pair of spools, thereby restricting, in the axial directions, the positions of the pair of spools. Moreover, it is possible to prevent the ink film from being erroneously mounted. This is because three of the four ends of the pair of spools are formed into the same shapes. One of the four ends of the pair of spools is formed into a shape which is different from the shapes of the three ends of the spools. Members, capable of being engaged with the engagement portions on the three ends of the pair of spools, are provided in the cassette. Members, capable of being engaged only with one end of the pair of spools, are also provided in the cassette.

DESCRIPTION OF THE PREFERRED EMBODIMENT

Figure 1:
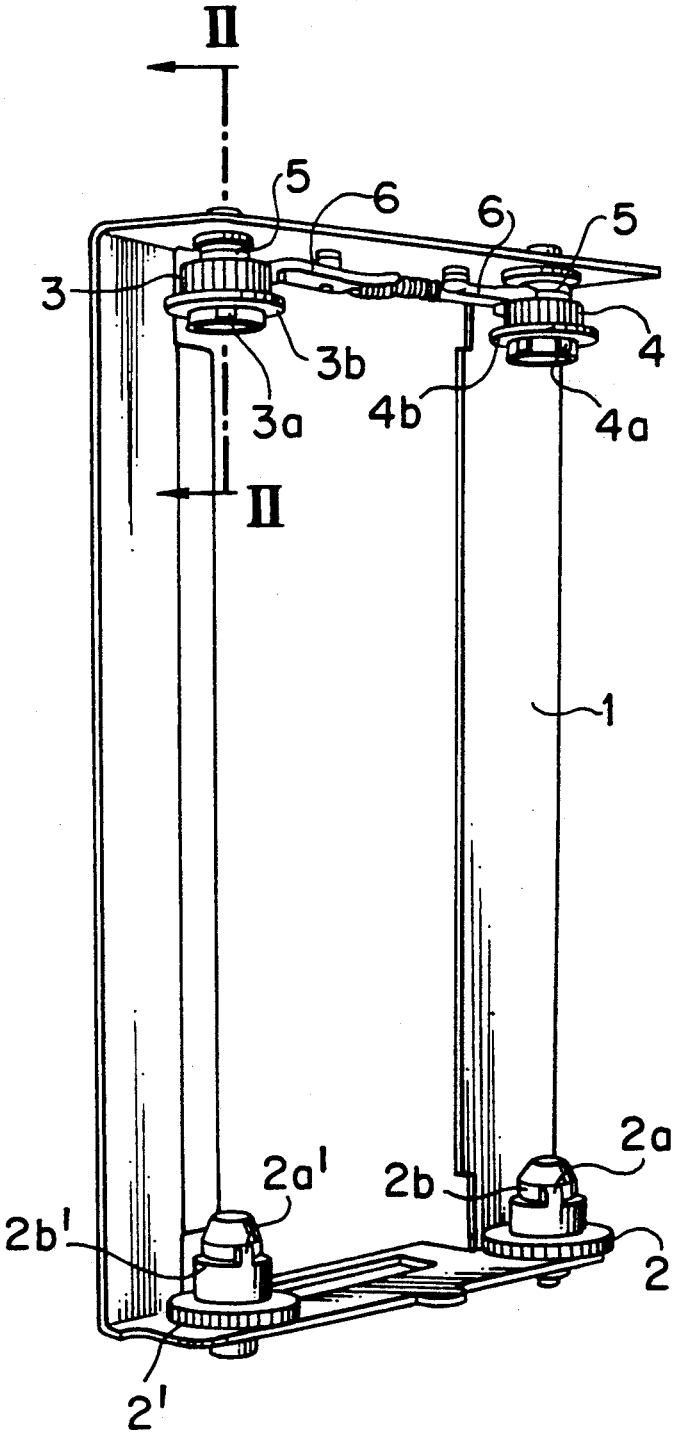
FIG. 1 is a schematic perspective view, showing an embodiment of the present invention, of an ink cassette for use in a thermosensitive transcription recording device.
Figure 2:
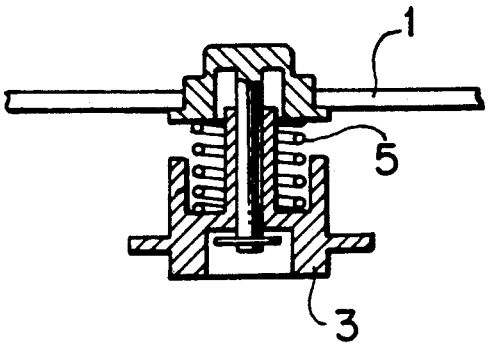
FIG. 2 is a cross-sectional view of a winding spool driven member taken along the line II—II of FIG. 1.

Four shafts are secured to a cassette case 1 shown in FIG. 1. A feed spool drive member 2, a feed spool driven member 4, a winding spool drive member 2', and a winding spool driven member 3 are all capable of rotating about their shafts. The feed spool drive member 2 and the winding spool drive member 2', when mounted in the thermosensitive transcription recording device, obtain turning force from a reel stand in the thermosensitive transcription recording device. The winding spool driven member 3 and the feed spool driven member 4 are capable of moving in the axial directions along the shafts of the cassette case 1. Springs 5 permit both of the members 3 and 4 to be pressed in a downward direction.

The feed spool drive member 2 includes ribs **2*a* and contact portions 2*b*, with the winding spool drive member 2' including ribs 2*a'* and contact portions 2*b'*, the winding spool driven member 3 including ribs 3*a* and contact portions 3*b*, and the feed spool driven member 4 including ribs 4*a* and contact portions 4*b*. The ribs 2*a*, 2*a'* and 3*a* are each located in separate positions, 180° apart from each other. Four ribs 4*a* are located in separate positions, 90° apart from each other, with the shapes of all of the ribs 2*a*, 2*a'*, 3*a*, and 4*a*** being the same.

An arm 6 is a ratchet mechanism with respect to the winding spool driven member 3 and the feed spool driven member 4 and allows both of the members 3 and 4 to rotate in only a single direction in which an ink film does not sag. When the cassette case 1 is mounted in the thermosensitive transcription recording device, however, the winding spool driven member 3 and the feed spool driven member 4 are disengaged from the arm 6, thereby being capable of rotating in both directions.

Figure 3:
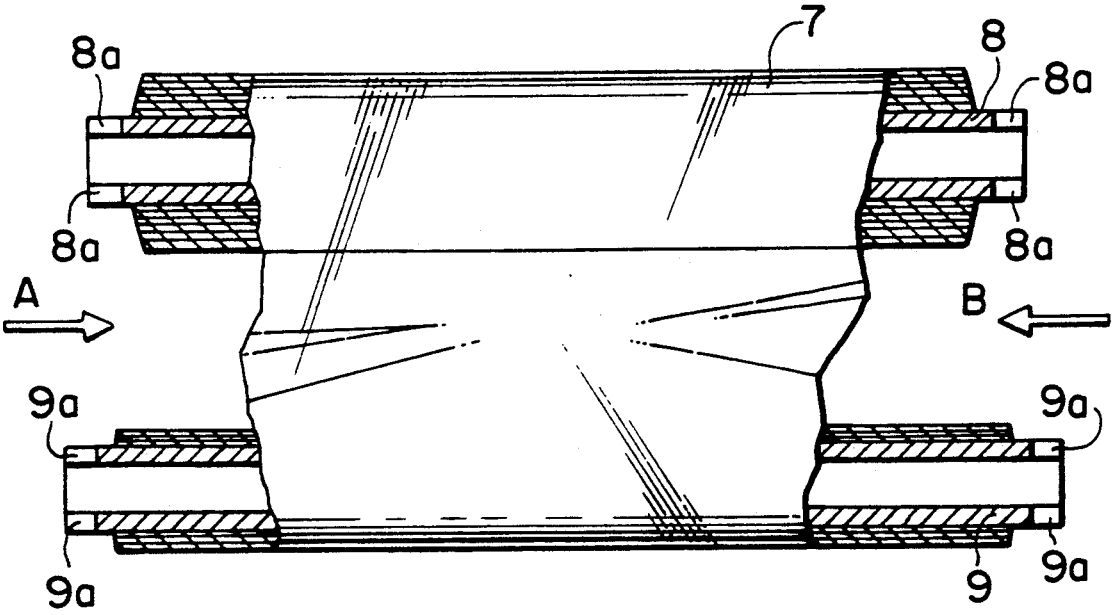
FIG. 3 is a fragmentary cross-sectional view showing an ink film and spools which are mounted on the ink cassette of the invention.
Figure 4:
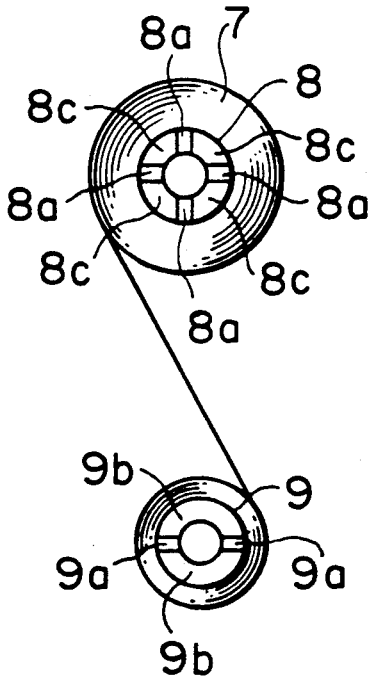
FIG. 4 is an end view as seen from direction A in FIG. 3.
Figure 5:
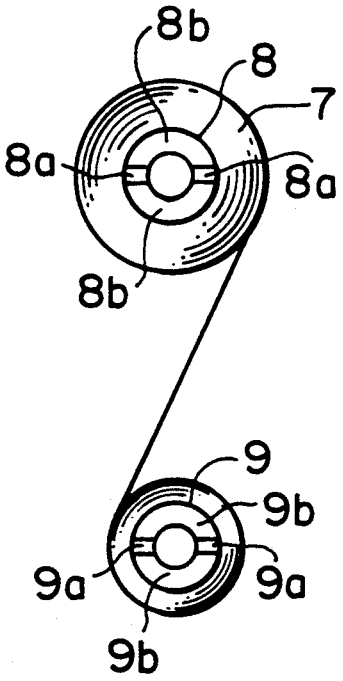
FIG. 5 is an end view as seen from direction B in FIG. 3.

An ink film 7 shown in FIGS. 3, 4, and 5, is wound around a feed spool 8 and a winding spool 9. One end of the ink film 7 is affixed on the feed spool 8, whereas, the other end of the film 7 is affixed on the winding spool 9. Reference characters 8*a*, 8*b*, and 8*c* respectively designate first engagement portions, second engagement portions, and third engagement portions of the feed spool 8. As shown in FIG. 5, the two first engagement portions 8*a* are located in separate positions on one end of the feed spool 8, 180° apart from each other. The four first engagement portions 8*a* are located in separate positions on the other end of the feed spool 8 shown in FIG. 4, 90°apart from each other. The winding spool 9 includes first engagement portions 9*a* and second engagement portions 9*b*. As illustrated in FIGS. 4 and 5, the two first engagement portions 9*a* are located in separate positions on each end of the winding spool 9, 180° apart from each other, whereas, the two second engagement portions 9*b* are located in separate positions on each end of the winding spool 9, facing each other across the first engagement portions 9*a*. The shapes of the first engagement portions 9*a* on one end of the winding spool 9 are the same as the shapes of the first engagement portions 9*a* on the other side of the winding spool 9. The shapes of the second engagement portions 9*b* on both the ends of the winding spool 9 are the same. The shapes of the first engagement portions 8*a* are the same as the shapes of the first engagement portions 9*a*. The first engagement portions 8*a* and the first engagement portions 9*a* are so shaped that they are capable of being engaged with the ribs 2*a*, 4*a*, 2*a*' and 3*a*.

The second engagement portions 8*b*, the third engagement portions 8*c*, and the second engagement portions 9*b* are so shaped that they are capable of being engaged, in the axial directions, with the contact portions 2*b*', 3*b* and 2*b*. However, the third engagement portions 8*c* of the feed spool 8 are only engagement portions that are capable of being engaged with the contact portions 4*b*.

Figure 6A:
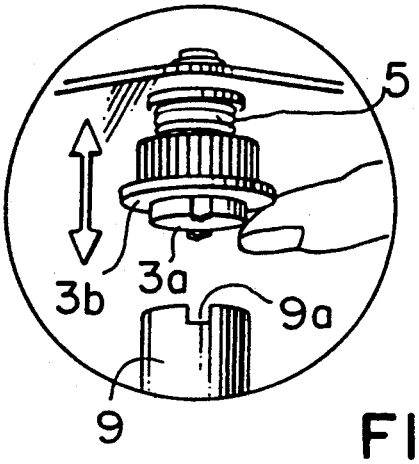
FIGS. 6A and 6B detailed views of the ink cassette of FIG. 6.
Figure 6B:
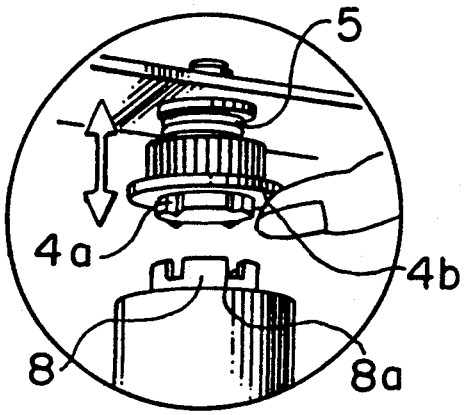
Figure 6:
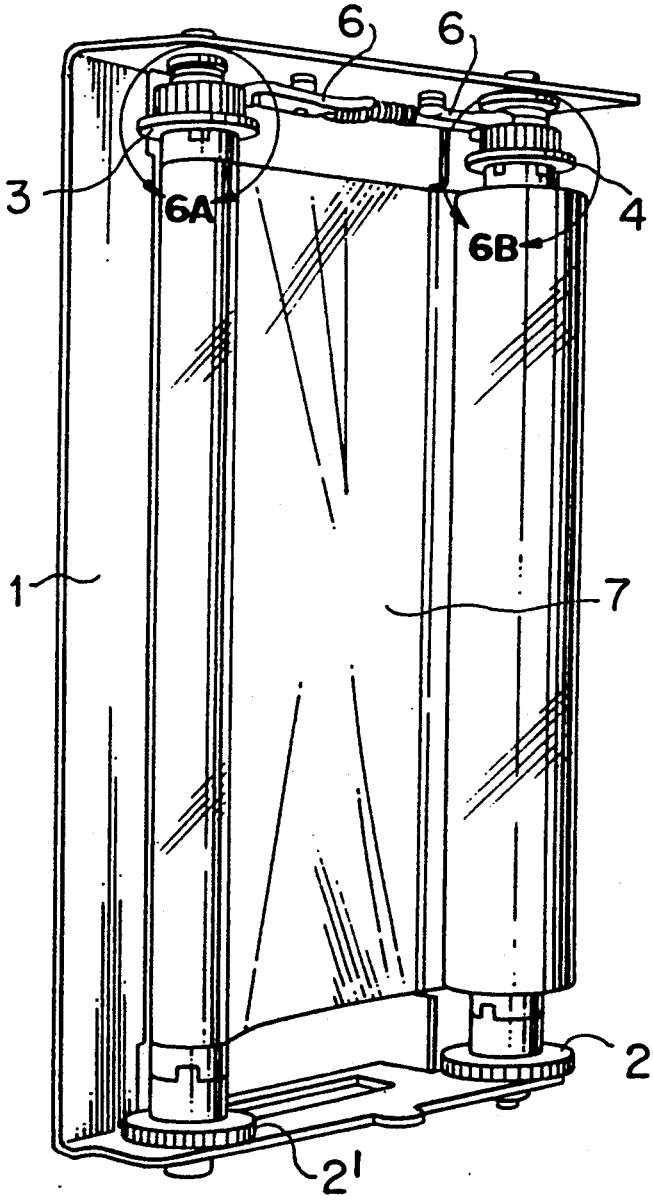
FIG. 6 is a perspective view illustrating the ink cassette on which the ink film of the present invention is mounted.

A mount operation, in which the ink film 7 is mounted on the ink cassette constructed above, will now be described with reference to FIGS. 6, 6A and 6B.

First, one end of the feed spool 8, on which the two first engagement portions 8*a* are formed, is fitted to the feed spool drive member 2. The first engagement portions 8*a* are then engaged with the ribs 2*a*. The second contact portions 8*b* are brought into contact with the contact portions 2*b*. Thereafter, the four first engagement portions 8*a*, formed on the other end of the feed spool 8, are engaged with the four ribs 4*a* of the feed spool driven member 4. The spring 5 then presses the contacts portions 4*b* downwardly, whereby the third engagement portions 8*c* are brought into contact with the contact portions 4*b*. The feed spool 8 is thus positioned in its axial direction by the clamping effect between the contact portions 2*b* and the contact portions 4*b*.

In the above operation, one end of the feed spool 8, on which the four first engagement portions 8*a* are formed, is fitted to the feed spool drive member 2. The first engagement portions 8*a* are then engaged with the ribs 2*a*. If the third engagement portions 8*c* are then brought into contact with the contact portions 2*b*, then, when the first engagement portions 8*a* on the other end of the feed spool 8 are engaged with the ribs 4*a*, the first engagement portions 8*a* cannot be engaged with the ribs 4*a*. This is because four ribs 4*a* are provided on the feed spool driven member 4, whereas, only two first engagement portions 8*a* are provided on the feed spool 8. Likewise, when the winding spool 9 is mounted on the feed spool drive member 2 and the feed spool driven member 4, either one of the ends of the feed spool 9 does not permit engagement.

To mount the winding spool 9 onto the winding spool drive member 2' and the winding spool driven member 3, one end of the winding spool 9 is fitted to the winding spool drive member 2' so as not to twist the coated and base faces of the ink film 7. The first engagement portions 9*a* of the winding spool 9 are then engaged with the ribs 2*a*' of the winding spool drive member 2'. The second engagement portions 9*b* of the winding spool 9 are brought into contact with the contact portions 2*b*' of the winding spool drive member 2'. Thereafter, the first engagement portions 9*a* on the other end of the winding spool 9 are engaged with the ribs 3*a* of the winding spool driven member 3. The spring 5 then presses the contacts portions 3*b* downwardly, whereby the second engagement portions 9*b* of the winding spool 9 are brought into contact with the contact portions 3*b* of the winding spool driven member 3. The winding spool 9 is thus positioned in its axial direction by the clamping effect between the contact portions 2*b*' of the winding spool drive member 2' and the contact portions 3*b* of the winding spool driven member 3. Furthermore, after the winding spool 9 has been mounted, the arm 6 restricts the winding spool driven member 3 and the feed spool driven member 4 so as to rotate only in a single direction. Thus, the ink film 7 does not sag and can be easily maintained.

What is claimed is:

1. A thermal transcription ink film cassette for use in a thermosensitive transcription recording device wherein engagement portions are provided to both ends of a pair of spools in which one end of an ink film is wound around the spool on a feeding side, the other end of the ink film being wound around the spool on a winding side, spool drive members are provided to one end of said cassette, said drive members being engaged with and fitted to said engagement portions on ends of said pair of spools, thereby causing said pair of spools to rotate, members are provided to the other end of the cassette, said members having a mechanism in which said members are engaged with the engagement portions on the other ends of said pair of spools, thereby controlling, in axial directions, positions of said pair of spools, and wherein the engagement portions on three of the four ends of the pair of spools are formed in the same shape, the engagement portions on the remaining one end of the four ends of said pair of spools being formed into shapes which are different from the shapes of the engagement portions on the three ends of the spools, and wherein engagement members, capable of being engaged with the engagement portions on said three ends of said pair of spools are provided in said cassette, and engagement members, capable of being engaged only with said one end of said pair of spools are also provided in said cassette.

* * * * *